United States Patent [19]

Kotthaus et al.

[11] 4,287,686

[45] Sep. 8, 1981

[54] CLAMPING APPARATUS FOR CLAMPING CUTTER BLADES OF A GEAR CUTTING MACHINE AT A GRINDING MACHINE

[75] Inventors: Erich Kotthaus, Wallisellen; Hans J. Spiess, Zürich, both of Switzerland

[73] Assignee: Werkzeugmaschinenfabrik Oerlikon-Bührle AG, Zürich, Switzerland

[21] Appl. No.: 130,047

[22] Filed: Mar. 13, 1980

[30] Foreign Application Priority Data

Mar. 27, 1979 [CH] Switzerland ..... 2823/79

[51] Int. Cl.[3] ..... B24B 3/02

[52] U.S. Cl. ..... 51/225

[58] Field of Search ..... 51/216 N, 216 H, 225, 51/288

[56] References Cited

U.S. PATENT DOCUMENTS 2,135,894 11/1938 Head ..... 51/225

3,916,582 11/1975 Costil ..... 51/288

FOREIGN PATENT DOCUMENTS 902351 1/1951 Fed. Rep. of Germany .

644548 10/1950 United Kingdom ..... 51/225

*Primary Examiner*—Harold D. Whitehead

*Attorney, Agent, or Firm*—Werner W. Kleeman

[57] ABSTRACT

A clamping or chucking apparatus is provided wherein the cutter blades or cutters, for the grinding thereof, are mounted in a cutter head. The cutter head is rotatable in the clamping apparatus about a cutter head axis, and further, is pivotably arranged for pivotable movement about a pivot axis. To provide a clamping apparatus having compact external dimensions and which, during adjustment of the cutter blades, requires very little freedom of movement room or space, and also possesses a good adjustment accuracy, the pivot axis is inclined and arranged at an acute angle with respect to the cutter head axis, such that the smallest spacing between the pivot axis and the cutter head axis is located externally of the clamping apparatus.

12 Claims, 7 Drawing Figures

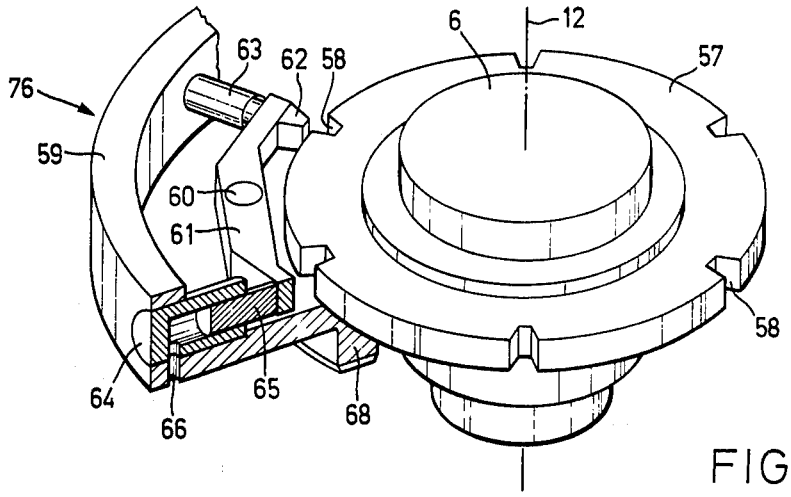
FIG. 3
FIG. 5
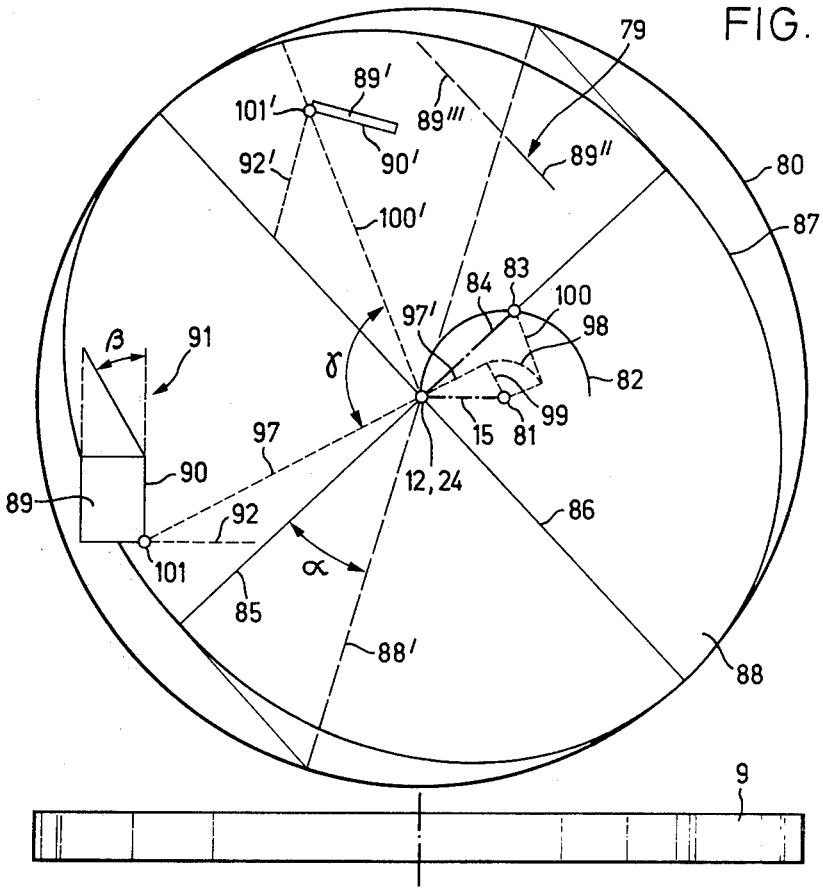

CLAMPING APPARATUS FOR CLAMPING CUTTER BLADES OF A GEAR CUTTING MACHINE AT A GRINDING MACHINE

CROSS-REFERENCE TO RELATED CASES

This invention is related to U.S. Pat. No. 3,487,592, granted Jan. 6, 1970, U.S. Pat. No. 4,183,182, granted Jan. 15, 1980 and the commonly assigned, copending U.S. Application Ser. No. 964,084, filed Nov. 27, 1978 and commonly assigned, copending U.S. Application Ser. No. 107,133, filed Dec. 26, 1979.

BACKGROUND OF THE INVENTION

The present invention relates to a new and improved clamping or chucking apparatus for clamping cutter blades or cutters of a gear cutting machine, during the grinding of such cutter blades, at a grinding machine, wherein the cutter blades are mounted in a cutter head and the cutter head is rotatable about a cutter head axis, and further, is pivotably mounted for pivotable movement about a pivot axis.

Clamping equipment of the heretofore described type serves for use at grinding machines for attachment of cutter heads of gear cutting machines during the grinding of the cutter blades or cutters which have been mounted at the cutter heads.

In German Pat. No. 902,351 there is disclosed a clamping apparatus of the type generally described above, wherein the cutter head is rotatable about a cutter head axis and is pivotable about a horizontal pivot axis which is arranged at right angles to the cutter head axis. In this equipment the cutter head is further rotatable about an additional, vertically arranged rotational axis. Such clamping apparatus is likewise displaceable at all sides in a horizontal plane and is elevationally adjustably arranged.

For setting the inclination of the cutters, prior to grinding thereof, with this state-of-the-art clamping apparatus it is necessary to initially rotate the cutter head about its own axis, then to pivot it about the pivot axis and the vertical axis of rotation. Thereafter, through displacement in the aforementioned plane, and equally, by carrying out an elevational adjustment, there must be then compensated the prior formed spacing between the grinding wheel and the surface of the cutter blade which is to be ground. Hence, in the grinding machine there must be provided long paths for the displacement of the clamping apparatus in the mentioned plane and also in elevation. This is associated with the drawback that there is required a correspondingly large amount of space.

With this prior art clamping apparatus there are provided scales and associated markers which are arranged concentrically with respect to the different axes. Since the radius, at which the scales and markers are arranged and read or adjusted, is smaller than the radius at which moves the surface of the cutter blade to be ground, any possible reading or adjustment inaccuracies are carried over.

Also carried over and transmitted to the bearings are the forces exerted by the grinding wheel or disk upon the cutter head. Although these forces, which arise at the grinding machine, for which there is provided the prior art clamping apparatus, are relatively small, nonetheless there must be feared deformations of the individual parts of the clamping apparatus. It is for this reason that the heretofore known clamping apparatus possesses an exceptionally heavy construction.

There is also known to the art from U.S. Pat. No. 2,135,894 a further construction of clamping apparatus of the general type heretofore described, wherein the cutter head is rotatable about a cutter head axis and can be pivoted about a horizontal pivot axis arranged perpendicular to the cutter head axis. In this case, once again the cutter head is further rotatable about an additional vertically arranged axis of rotation.

With this prior art construction of clamping apparatus there is required a great deal of free space, in order to be able to bring the elements, supporting the cutter head, into positions enabling grinding of the cutter blades with the standard inclination angle of the relevant flanks of the cutter blades. The effective line of the forces, transmitted during grinding at the cutter head, extend far outside of the support surfaces of the bearing arrangement of the different pivotable and adjustable elements. This in turn requires an extremely rigid and robust construction of the bearing arrangement and also the individual elements.

In order to be able to displace the part of the clamping apparatus which is pivotable about a horizontal axis, for instance from a lower position into an upper position, the entire weight of this part must be overcome, which in conjunction with the bearing friction which is to be overcome and which is to be expected from the nature of the support or bearing arrangement for such part, corresponds to an appreciable expenditure in force. Therefore, there are required specially constructed devices in order to move these parts, which, in turn, again increases the space requirements of such clamping apparatus. Owing to the play which is present within the individual devices, and which is needed for displacement of the individual elements relative to one another, with this prior art equipment design there is likewsie an impairment of the accuracy.

SUMMARY OF THE INVENTION

Therefore, with the foregoing in mind it is a primary object of the present invention to provide a new and improved construction of clamping apparatus for clamping cutter blades of a gear cutting machine at a grinding machine in a manner not afflicted with the aforementioned drawbacks and limitations of the prior art proposals.

Another and more specific object of the present invention aims at providing a new and improved construction of clamping or chucking apparatus for clamping cutter blades or cutters of a gear cutting machine at a grinding machine, which apparatus possesses compact external dimensions and, for the purpose of setting the inclination of the cutter blades, requires an extremely small amount of freedom of movement space and which, furthermore, enables setting the inclination of the cutter blades with increased accuracy.

Now in order to implement these and still further objects of the invention, which will become more readily apparaent as the description proceeds, the clamping apparatus of the present development for the clamping of cutter blades or cutters of a gear cutting machine, during the grinding of the cutter blades at a grinding machine, is manifested by the features that the pivot axis is inclined with respect to the cutter head axis at an acute angle and arranged in such a manner that the smallest spacing between the pivot axis and the cutter head axis is located externally of the clamping apparatus. Particular advantages of the inventive clamping apparatus which are worthy of mention, reside in the fact that the forces exerted during grinding by the grinding wheel through the cutter head at the clamping apparatus, can be taken-up by largely dimensioned bearings. These bearings, which render possible the rotation of the individual parts of the clamping apparatus about the different axes, viewed with respect to the line of action of the above-mentioned forces, are only slightly laterally offset behind one another. Therefore, these bearings are not exposed to any large rotational moments or torques, and no forces which are translated by any lever action. Therefore, it is possible to realize an increased grinding efficiency, since there can be tolerated the greater forces for the clamping apparatus which arise during surface contact between the grinding disk and the cutter blades in relation to line contact.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 illustrates part of the clamping apparatus in perspective view;

FIG. 5 is a schematic illustration of a cutter head, clamped at the clamping apparatus, and showing such cutter head in two different positions;

DETAILED DESCRIPTION OF THE PREFERRED EMBODIMENTS

Figure 1:
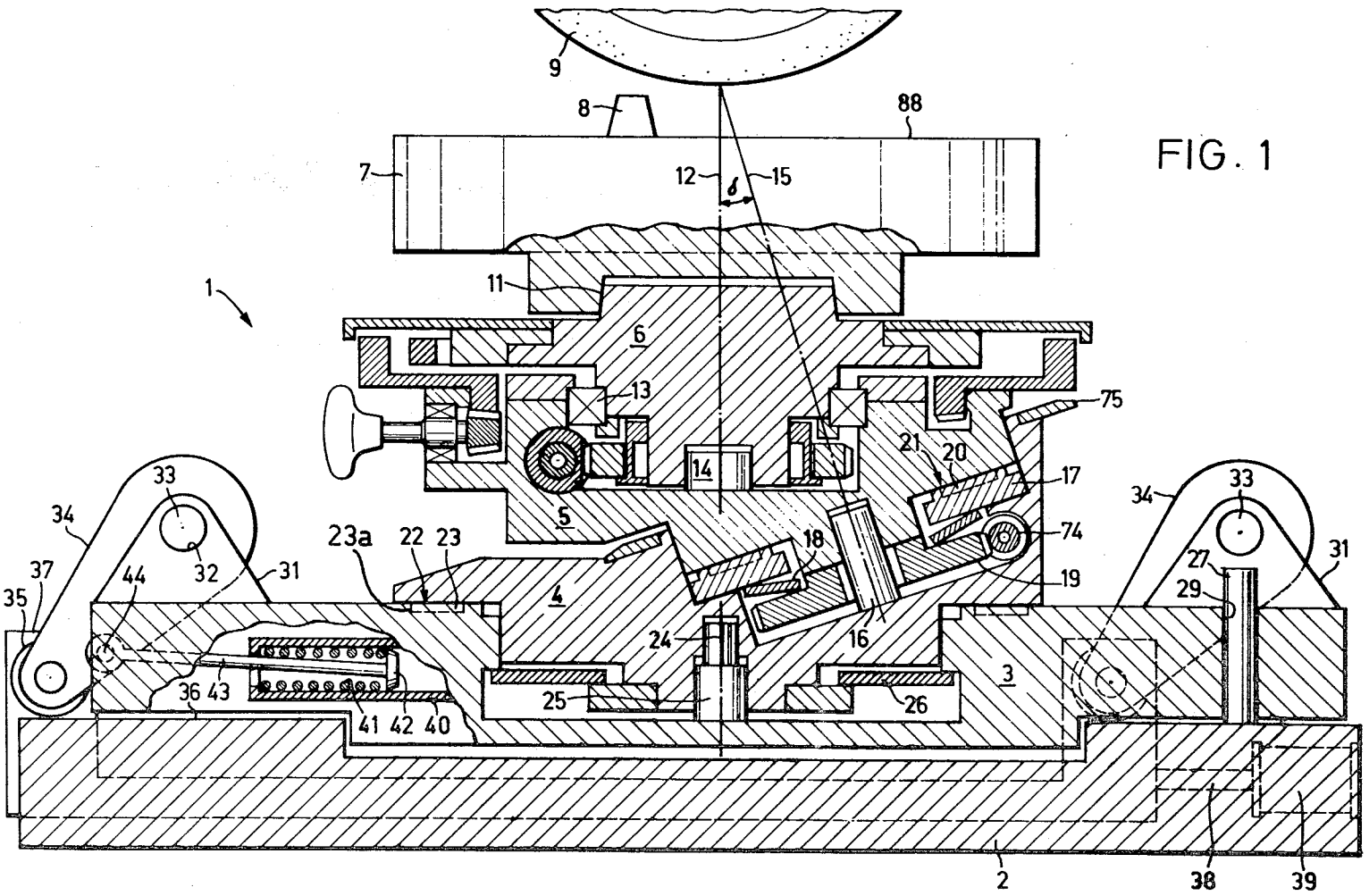
FIG. 1 is a sectional view through a clamping apparatus constructed according to the invention.

Describing now the drawings, in FIG. 1 there will be recognized an exemplary embodiment of clamping apparatus 1, constructed according to the invention, with its five primary or main components or elements: the sliding table 2, the lifting or elevation table 3, the rotational element 4, the pivotal element 5 and the cutter head support or carrier 6. Arranged thereon is a cutter head 7 having a cutter blade or cutter 8. The remaining cutter blades 8 of the cutter head 7 have not been particularly shown to simplify the illustration. Additionally, there will be recognized a grinding wheel or disk 9 which is movable at a grinding machine 10 (FIG. 6) in vertical direction.

The cutter head 7 is connected by means of a cone element 11 free of play with the cutter head support 6. The cutter head support 6 is rotatably arranged at the pivotable part of element 5 for pivotable movement about a cutter head axis 12. The cutter head support 6 is supported by means of a roller bearing 13 or equivalent structure at the pivotal element 5. A cylinder 14, arranged at the pivotal element or part 5, serves in a manner which is well known in this technology, for the transmission of pressurized oil from the pivotal element 5 to the cutter head support 6.

The pivotal element 5 is pivotably mounted at the rotatable part or element 4 for pivotal movement about a pivot axis 15 which, in this embodiment, intersects the cutter head axis 12 at an acute angle $\delta$. A cylinder 16 arranged at the rotatable element 4 also serves in this case for the transmission or feed of the pressurized oil or other suitable pressurized fluid medium. In axial direction the pivotal or pivotable element 5 bears, by means of a bearing ring 17, upon the rotatable element 4. A plate spring 18, arranged between the bearing ring 17 and a worm gear 19 secured at the pivotable part or element 5, draws the pivotal element 5 against the bearing ring 17. Pockets or chambers 20, shown in broken lines in FIG. 1, formed at the top of the bearing ring 17 and distributed over its entire periphery, are connected in conventional and known manner with any suitable oil supply. The bearing ring 17 together with the pockets 20 thus forms a hydrostatic bearing 21 for the pivotable part or element 5. A worm 74, mounted at the rotatable element 4, meshes with the worm gear 19. By rotating this worm 74 it is possible to pivot the pivotable element 5 upon the rotatable element 4. Due to the inherent friction or locking action between the worm gearing 19, 74, it is not possible for the pivotable element 5 to rotate upon the rotatable element 4 when the worm 74 is stationary.

A further hydrostatic bearing 22 consists of pockets or chambers 23, again shown in broken lines in FIG. 1, which are formed in a ring 23*a* and inserted at the lifting or elevation table 3. These pockets 23 are likewise connected in appropriate fashion with an oil supply or other suitable source of a pressurized fluid medium. Hence, the rotatable element 4 is arranged to be rotatable about an axis of rotation 24 upon the lifting or elevation table 3, this rotational axis 24 being inclined, in relation to the pivot axis 15, through an acute angle $\epsilon$, and a cylinder 25 is secured to the lifting or elevation table 3 serves for the transmission or infeed of the pressurized oil to the rotatable element 4. A plate spring 26 also, in this case, pulls the rotatable element 4 towards the lifting or elevation table 3.

The lifting table 3 is arranged to be vertically movable upon the sliding table 2. As the guide means there can be used a shaft 27 secured to the sliding table 2, this shaft 27 sliding free of play in a bore 29 provided at the lifting or elevation table 3. Such type guides or guide means 27, 29 are arranged at both sides of the rotatable element 4. The section through the clamping apparatus 1 has been laid in FIGS. 1 and 2 such that at both sides of the illustrations there will be apparent different constructional features.

Equally arranged to both sides of the rotatable element 4 are the bearing or pillow blocks 31. Within a bore 32 there is mounted therein a shaft 33 which is connected with a pivot lever 34. At the end of the pivot or pivotal lever 34 there is mounted a wheel or roll 35 which can roll upon a surface 36 of the sliding table 2. Two oppositely situated wheels 35 or pivot levers 34 are interconnected by means of a bracket 37. This bracket or bracket member 37 is connected, by means of a piston rod 38, for instance with a hydraulic cylinder 39. This hydraulic cylinder 39 is supplied in any suitable manner with oil under pressure. Within a cylinder 40 there is arranged a spring 41 or equivalent structure which is pre-biased. This spring 41 bears at one end against the cylinder 40 and at its other end against a plate 42. This plate 42 is fixed at one end of a rod 43, which is attached at its other end, by means of a bolt 44 or equivalent structure with the pivotal lever 34. This device serves for weight compensation, so that for the lifting motion there is needed lesser force and the shafts 27 can take-up low radial forces.

Figure 2:
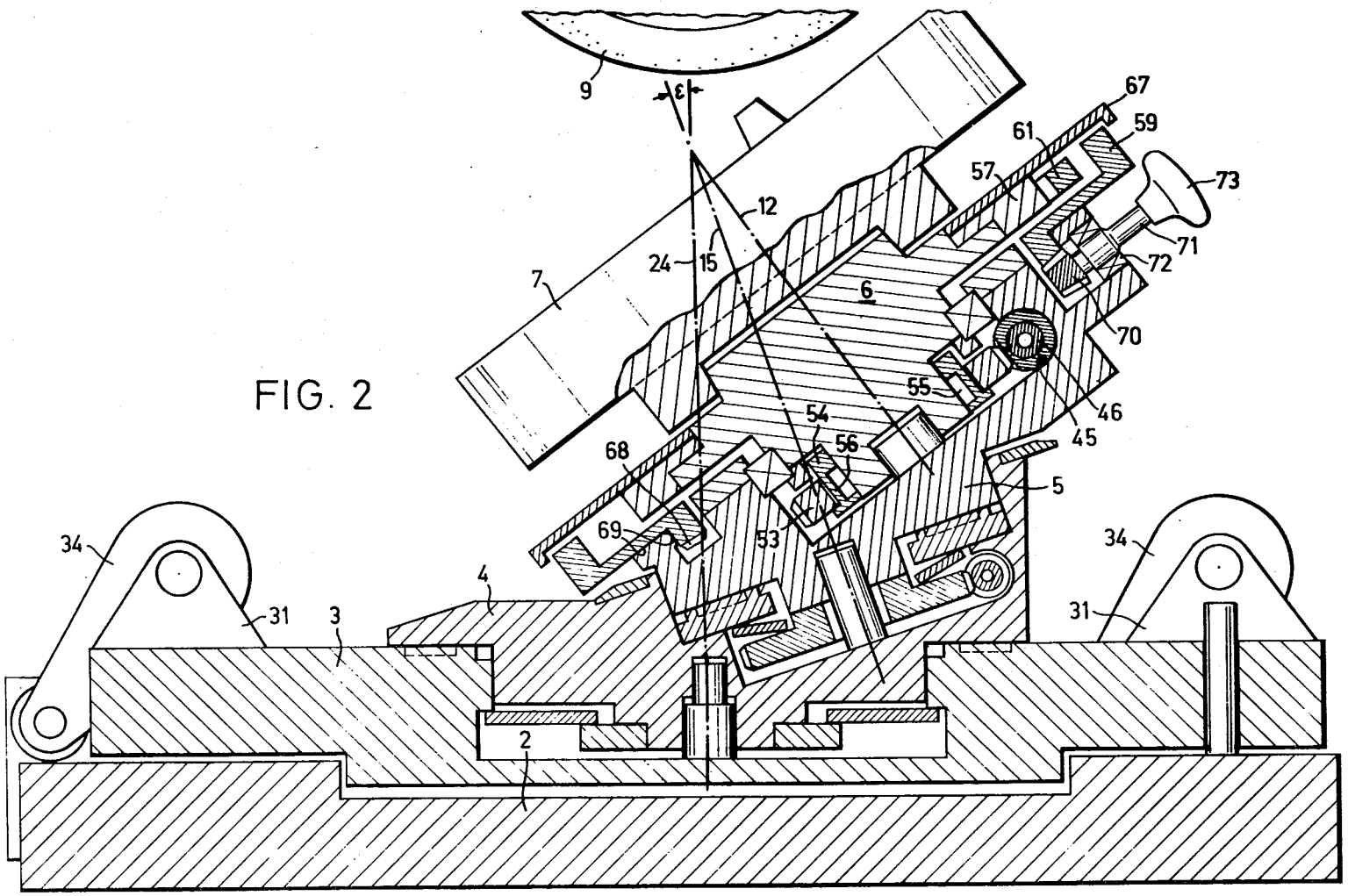
FIG. 2 is a sectional view, corresponding to the showing of FIG. 1, wherein the cutter head has been illustrated in a different position.

Continuing, by referring to FIG. 2 it will be recognized that the pivotal element or part 5 can be rotated, in relation to its position shown in FIG. 1, through 180° about the pivot axis 15. The cutter head axis 12, and thus, the cutter head 7 is inclined, in this position, by the double angle δ between the cutter head axis 12 and the pivot axis 15 in relation to the rotational axis 24.

Provided in the pivotal part 5 is a cylinder 45, in which there is arranged a piston 46 for to-and-fro movement. This piston 46 consists of two parts, as best seen by referring to FIG. 4, namely an outer piston 47 and an inner piston 48. The outer piston 47 and the inner piston 48 are mutually connected with one another by the threads 49 or equivalent structure. A square rod or bar 50 engages with one end into the internal piston 48 and is attached at its other end in an adjustment ring 51. Bu rotating the adjustment ring 51 it is possible to also rotate, by means of a square rod 50, the inner piston 48. Consequently, the inner piston 48 and the outer piston 47 are threaded towards one another or away from one another, whereby it is possible to vary the total length of the piston 46. A gear rack 52 is formed at the outer piston 47 at one side thereof. This gear rack 52 meshes with a spur gear 53. Hence, the outer piston 47 is secured against rotation within the cylinder 45. Since the length of the cylinder 45 is constant, but however the length of the piston 46 is variable, it is therefore possible to adjust the stroke of the piston 46, and thus, correspondingly the rotational angle of the gear 53 per stroke movement at the adjustment ring 51.

For instance, it will be apparent from the showing of FIG. 2 that a ring member or ring 54 is placed about the cutter head support 6. This ring member 54 possesses a groove 55 into which there can be pumped oil or other suitable fluid medium, from here not particularly illustrated but conventional hydraulic lines from an oil supply or reservoir. The ring or ring member 54 supports from below the gear 53 which encircles the same. Between this spur gear 53 and the ring member 54 there is provided sufficient play, so that the spur gear 53 can freely rotate. If the oil is placed under pressure in the groove or channel 55, then one wall 56 of the ring 54 bends towards the spur gear 53, thereby eliminating the play. The spur gear 53, in this case, is coupled with the cutter head support 6.

In FIG. 3 there has been shown in perspective and partially sectional view an adjustment device 76. There will be recognized an index disk or plate 57 which is attached to the cutter head support or carrier 6. The index disk or plate 57 can be exchanged and carries at its circumference a number of recesses or depressions 58. Arranged concentrically with respect to the cutter head axis 12 is an adjustment or adjusting ring 59. A lever 61 is rotatably mounted by means of a bolt 60 or equivalent structure upon the adjustment ring 59. Lever 61 carries at one end an adjustment dog or cam 62. The shape of the recesses 58 is identical with the shape of the adjustment cam or dog 62, so that these components can engage free of play with one another. In the rest position a spring element 63 presses the adjustment dog 62 into one of the recesses 58. A piston 65, engaging at the other end of the lever or lever member 61 and arranged in a cylinder 64, can rotate the lever 61, whenever the cylinder 64 is supplied with pressurized oil by means of the line or conduit 66, about the bolt 60 against the action of the resilient or spring element 63. Hence, the adjustment dog 62 is withdrawn from the related recess 58 and the cutter head support 6 and adjustment ring 59 can be rotated relative to one another.

The adjustment ring 59, the index disk 57, and equally the lever 61, also will be recognized for instance by referring to FIG. 2. These elements, in this case however are closed off by a cover 67 and protected against possible contamination. In FIG. 2 there will also be likewise recognized that the adjustment ring 59, bears by means of the bearing surfaces 69, upon the pivotal part or element 5. Additionally, the adjustment ring 59 has a slightly conical-shaped tooth arrangement 68. Engaging with the conical tooth arrangement or teeth 68 is a bevel gear 70 secured to a shaft 71. This shaft 71 is mounted, for instance by means of roller bearings 72, in the pivotal element or part 5 and carries at its outer end a handwheel 73 or equivalent structure. By rotating this handwheel 73 it is therefore possible to rotate the adjustment ring 59 upon the pivotal element 5 about the cutter head axis 12.

Figure 6:
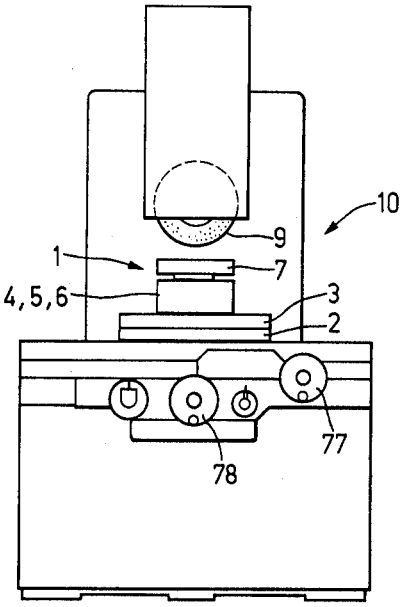
FIG. 6 illustrates on a reduced scale the clamping apparatus arranged at a grinding machine.

By referring to FIG. 6, there will be recognized the manner in which the clamping apparatus 1 is arranged upon a grinding machine 10 containing the grinding wheel or disk 9. By rotating the handwheel 77 it is possible to displace the sliding table 2, and thus, the entire clamping or chucking apparatus 1 in conventional manner parallel to the plane of the grinding wheel 9 and by means of a handwheel 78 perpendicular thereto.

Figure 7:
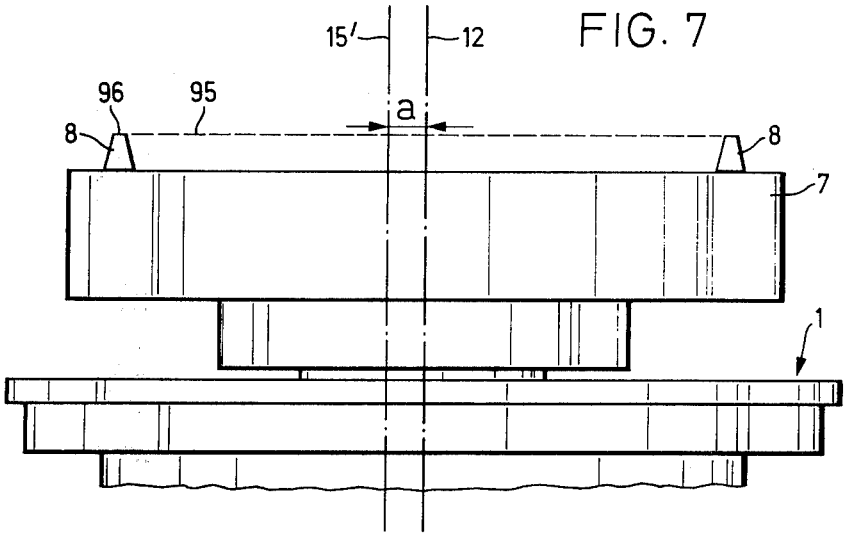
FIG. 7 is a simplified illustration of a further embodiment of clamping apparatus.

In FIG. 7 there is shown a further embodiment of inventive clamping apparatus 1. This modified version of clamping apparatus has only been partially illustrated and then from a different angle of viewing than the embodiment of FIGS. 1 or 2. The viewing direction is, for instance perpendicular to that of FIG. 1, and chosen such that a projection 15' of the pivot axis 15, in this case, appears as being parallel to the cutter head axis 12. The pivot axis 15, in reality, is also inclined to the plane of the drawing, or the pivot axis 15 and the cutter head axis 12 are located obliquely with regard to one another. There will be recognized the cutter head 7 containing the cutter blades or cutters 8, whose tips or top lands 96 are located at the broken line illustrated plane 95. The smallest spacing a between the cutter head axis 12 and the actual pivot axis 15 is therefore located near or at the region of the plane 95.

Having now had the benefit of the foregoing description of the various embodiments of clamping apparatus for clamping cutter blades of a gear cutting machine at a grinding machine, its mode of operation will now be considered and is as follows:

In order to grind a cutting surface or flank of a cutter blade 8 the cutter head 7 is mounted upon the cutter head support or carrier 6. A not particularly here shown screw which is coaxially arranged with respect to the cutter head axis 12, serves for the attachment of the cutter head 7 in a manner well known in this technology. A here likewise not further illustrated, radially arranged key or wedge serves for positioning purposes, so that the cutter head 7 cannot be mounted randomly rotatably turned in relation to the cutter head support or carrier 6.

In the case of the cutter head 7, which contains a number of identical groups of cutter blades each having different types of cutter blades, it is normally desired to successively grind the same cutting surfaces or flanks of the cutter blades of the same type of cutters in succession. The indexing disk or plate 57 therefore must possess a number of the desired recesses 58, corresponding to the number of groups of cutters mounted upon the cutter head 7. If this is not the case, then the indexing disk or plate 57 must be exchanged prior to mounting of the cutter head 7. This occurs in that initially the cover or cover member 67 is removed, the not particularly shown attachment elements for the indexing disk 57 are disconnected and such is lifted-off. The same operations are carried out in the reverse sequence when mounting a new indexing disk 57. Here also attention must be paid to the positioning means which ensure that mounting of the indexing disk 57 only can be carried out in a predetermined position in relation to the cutter head support or carrier 6. In order to activate the indexing disk 57 the piston 65 within the cylinder 64 is impinged with pressurized oil or another suitable pressurized fluid medium. The lever 61 is thus tilted about the bolt 60 such that the positioning or adjustment dog 62 cannot engage into the recesses 58 against the action of the spring or resilient element 63.

After the mounting of the indexing disk 57 the adjustment or positioning ring 59 and the cutter head support 6 are rotated relative to one another such that the adjustment or positioning dog or cam 62 is situated opposite one of the recesses 58. Then the oil pressure within the cylinder 64 is again lowered and the adjustment dog 62, under the action of the pressure of the spring or resilient element 63, engages into the related recess 58.

In order to adjust the inclination of the cutter head 7 the hydrostatic bearing 21 must be supplied with pressurized oil. The oil which is under pressure in the pockets 20 lifts the pivotal element or part 5 slightly from the bearing ring 17 against the action of the plate spring 18. Otherwise the pivotal part 5 can hardly be rotated. By rotating the worm 74 by means of a not particularly shown handwheel or the like the pivotal part or element 5 is rocked to such an extent about the pivot axis 15, until a conventional marker provided at the pivotal element 5 indicates at a scale ring 75 the desired inclination of the cutter head 7. Thereafter the oil pressure within the hydrostatic bearing 21 is again lowered, so that the rotational element 4 and the pivotal element 5 can remain in such relative position with respect to one another. Thereafter, by rotating the handwheel 73 the cutter head 7 is further rotated about the cutter head axis 12, until there is attained a further position 79 which will be described more fully hereinafter in conjunction with FIG. 5.

Now there is built up an oil pressure in the hydrostatic bearing 22, so that the rotational element 4 can be rotated in relation to the lifting or elevation table 3. This rotation is carried out to such a degree until the blade surface which is to be ground is located parallel to the plane of the grinding wheel 9. Then the pressure in the pockets 23 is again relieved and the rotatable element 4 is fixedly seated upon the lifting table 3.

By rotating the handwheels 77, 78 (FIG. 6) at the grinding machine 10 the surface of the blade which is to be ground is further exactly positioned relative to the grinding wheel 9. For the grinding operation the hydraulic cylinder 39 is pressurized, and the bracket element or bracket 37 is drawn, by means of the action of the piston rod 38 to the right of the showing of FIG. 1. Hence, the rolls 35 roll upon the surface 36 and the pivotal levers 34 alter their inclination. This construction ensures that in the case of pivot levers 34 which continuously change their inclination, the lifting or elevation table 3 always will be raised more slowly. After there has been accomplished contact of a cutter blade 8 with the grinding wheel or disk 9 it is therefore possible, by further raising the lifting table 3, to exactly regrind the cutter blade 8 to the desired depth.

Figure 4:
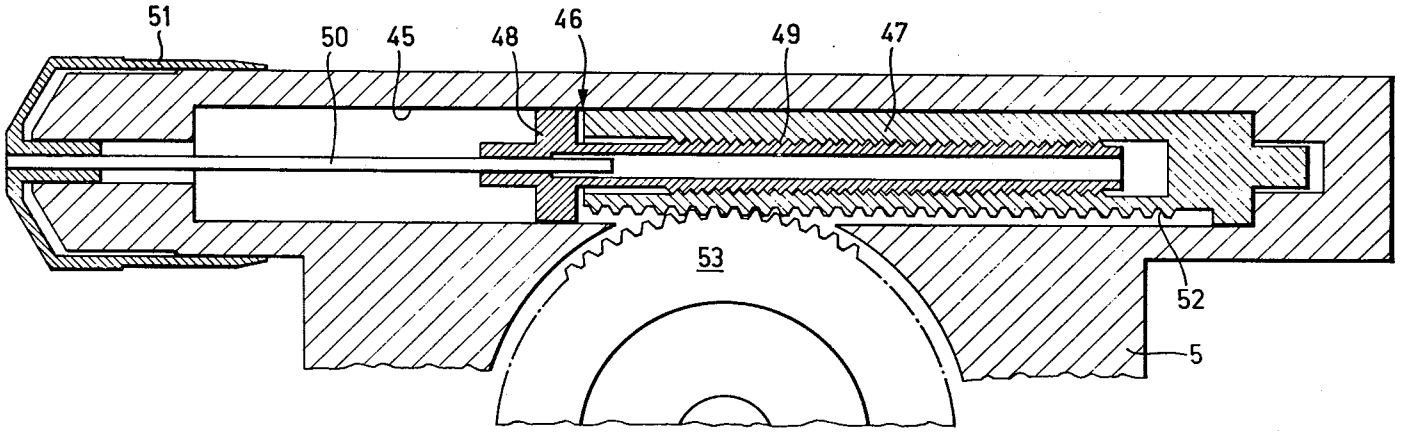
FIG. 4 is a sectional view through part of the clamping apparatus.

Now in order to be able to bring a surface of a further cutter blade 8 of the same type of cutter blades, but of another cutter blade group at the cutter head 7, and which surface is exactly oriented in the same manner with respect to the cutter head axis 12, below the grinding wheel 9 there are performed at the clamping apparatus 1 the following operations:

The groove 55, shown in FIGS. 1 and 2, is filled with pressurized oil, and the spur gear 53 is coupled with the cutter head support or carrier 6. The cylinder 64 (FIG. 3) is likewise filled with pressurized oil, and the piston 65 tilts the lever 61, so that the adjustment or positioning dog 62 is retracted out of the recess 58. In the cylinder 45, as shown in FIG. 4, there is likewise introduced pressurized oil in any suitable manner, so that the piston 46 is shifted into its other terminal position, which for instance would be to the left-hand side of the showing of FIG. 4. Because the cutter head support 6 is just coupled with the gear 53, the cutter head 7 and together therewith the indexing disk or plate 57 are rotated. In this respect it is to be observed that the stroke of the piston 46 at the adjustment ring 51 is adjusted such that the stroke motion of the piston 46 rotates the indexing disk 57 to just such an extent until the next recess 58 again comes to lie opposite the adjustment or positioning dog or cam 62. Then the pressurized oil again can be withdrawn from the groove or channel 55 and out of the cylinder 64 and the adjustment dog 62 again engages into one of the recesses 58. Now the cutter head 7 is secured against rotation and it can be raised for the purpose of grinding such cutter blade surface. These operations repeat until all of the similarly oriented blade surfaces of the cutter blades 8 of the same types of cutters have been ground.

In order to grind further surfaces of the cutter blades 8 of the same or of a different type of cutter blades, then in conventional manner it is necessary to newly set the inclination of the cutter head 7.

FIG. 5 illustrates the outline or contour of the cutter head 7 viewed from the top. In its horizontal position, as shown in FIG. 1, it appears as a circle 80. The cutter head axis 12 is located at the center of the circle 80 and here appears as a point, since it is disposed perpendicular to the plane of the circle 80. The pivot axis 15, here illustrated by short chain-dot representation, is here assumed to be of finite length. It extends therefore from the center of the circle 80 up to a point 81 and is inclined by the angle $\delta$ (see FIGS. 1 and 2). In FIG. 5 there will be observed its projection onto the plane of the circle 80. The point 81 forms the center of an ellipse 82, only half of which has been here illustrated. A not further illustrated plane, located perpendicular to the pivot axis 15 and intersecting such at the point 81, also intersects the cutter head axis 12 at a point P and this point P describes the ellipse 82 when the cutter head axis 12 is pivoted about the pivot axis 15. In the example under discussion according to FIG. 5, the cutter head axis 12 and the pivot axis 15 intersect at a cutter head surface 88.

The cutter head axis 12 and the pivot axis 15 collectively form, in each case, a plane which can be rotated about the pivot axis 15 whenever the cutter head axis 12 is pivoted. Now if the cutter head axis 12 is pivoted to such an extent until such forms with respect to its original position, in this embodiment assumed to be vertical, an angle $\alpha=30°$, then the above-described point P migrates along the ellipse 82 into the position 83. In FIG. 5 the cutter head axis 12 appears as the projection 84 in its position which is inclined by $\alpha=30°$ in relation to its original vertical position. Therefore, there are defined the major axes 85, 86 of the outline or contour of the cutter head 7 appearing as the ellipse 87. These major axes 85, 86 are differently oriented in space depending upon the inclination angle $\alpha$. A flipping over, coursely represented in FIG. 5 by reference character 88', about the major axis 85, enables recognition of the inclination of the cutter head surface 88.

Let there now be considered, with initially horizontally oriented cutter head 7, a randomly oriented or positioned surface 89, which protrudes past the cutter head surface 88 and intersects such at a base line 90. This surface 89 should be ground and vertically oriented by inclining the cutter head 7. Since there has already been described the case of a cutter head 7 which is inclined through the angle $\alpha=30°$, it is assumed that the surface 89 likewise is inclined by $\beta=30°$ in relation to the cutter head axis 12. This is apparent from the flipped over representation 91. The straight line 92 indicates the direction of the fall line of the surface 89.

In order to determine where the surface 89 is located following the pivoting about the pivot axis 15, there is selected a point 101 upon the base line 90, which belongs both to the surface 89 and also to the cutter head surface 88 and there is attempted to find out its new position following the pivoting action. There is further assumed that the point 101 is located in a common plane with the cutter head axis 12. This common plane intersects the cutter head surface 88 at a straight line 97. Equally, the common plane intersects the plane of the ellipse 82 at a straight line 97'.

During pivoting about the pivot axis 15 the straight line 97' pivots in the plane of the ellipse 82 about the point 81. The spacing 99 between such point 81 and the straight line 97' is maintained, since such is located, also during the pivoting motion, always tangential to an ellipse 98. At the end of the pivotal movement the cutter head axis 12 appears as the projection 84 upon the plane of the circle 80. The cutter head axis 12 intersects the plane of the ellipse 82 now at the point 83 and the straight line 97' appears as a straight line 100. The plane, which is formed by the straight line 100 and the cutter head axis 12 appearing as the projection 84, intersects the cutter head surface 88 at a straight line 100' which extends parallel to the straight line 100. The straight line 100' which is nothing other than the pivoted straight line 97, also contains the pivoted point 101, now designated by reference character 101'. Its exact position can be determined by flipping over about the straight line 100', something however which is well known and therefore not here further illustrated. If this procedure is carried out for a further point of the base line 90, then there will be obtained a base line 90' of the pivoted plane 89'.

Thereafter, the cutter head 7 is rotated further about the cutter head axis 12, located in its new position and appearing as the projection 84, until the surface 89' is disposed perpendicular to the smaller major axis 85 (i.e. minor axis) of the ellipse 87. Thus it is also oriented vertically in space and appears as the surface 89'' or in the flipped over position as the surface 89'''. Hence, the surface 89 has been transposed into the desired position 79.

By rotating the surface 89'' about the rotational axis 24, which here coincides with the cutter head axis 12 located in the starting position, this cutter head axis can now be oriented parallel to the grinding wheel or disk 9.

From the showing of FIG. 5 it will be apparent that the pivot angle $\delta$, through which there must be pivoted the pivotal element 5 about the pivot axis 15, in order to for instance incline the cutter head 7 through the angle $\alpha=30°$, must be appreciably greater than the angle $\alpha$. From this it folows that the scale at the scale ring 75 must be applied for instance such that at that location there can be directly read-off inclination of the cutter head 7. This condition allows for attainment of an increased reading and adjustment accuracy. If, for instance, there is used a profiled grinding wheel, then its profile angle must be taken into account during the angular computation of the inclination of the cutter head.

With the design of the inventive clamping apparatus the angle $\delta$ between the pivot axis 15 and the cutter axis 12 is chosen to be half as large as the maximum desired inclination of the cutter head 7 with respect to its starting position or half as large as the angle $\beta$ for the inclined surface of the cutter blade 8 which is to be ground and which inclination is most pronounced in relation to the cutter head axis 12. Here there must be taken into account any additionally prevailing profile angles of the grinding wheel 9.

Axes arrangements, deviating from those shown by way of example in the exemplary embodiments, are possible and only constitute further modifications of the invention which will readily suggest themselves to those skilled in the art.

Depending upon the arrangement of the cutter blade 8 at the cutter head 7 it is necessary, during the grinding operation, to lower the unground cutter blades 8, so tha they do not protrude past the cutter head surface 88.

While there are shown and described present preferred embodiments of the invention it is to be distinctly understood that the invention is not limited thereto, but may be otherwise variously embodied and practised within the scope of the following claims. ACCORDINGLY,

What we claim is:

1. A clamping apparatus for clamping cutter blades of a gear cutting machine, during the grinding of the cutter blades, at a grinding machine, comprising:

a cutter head in which there is mounted the cutter blades to be ground;

means for mounting said cutter head to be rotatable about a cutter head axis;

means for mounting said cutter head to be pivotable about a pivot axis;

said pivot axis being inclined through an acute angle with respect to said cutter head axis and arranged such that the smallest spacing between the pivot axis and the cutter head axis is located externally of the clamping apparatus;

said clamping apparatus has an axis of rotation which is inclined at an acute angle with respect to the pivot axis; and said pivot axis and said cutter head axis are rotatable about said axis of rotation.

2. The clamping apparatus as defined in claim 1, wherein:

said smallest spacing between the cutter head axis and the pivot axis is located at the region of a plane in which there is situated a top land of the cutter blade of the cutter head.

3. The clamping apparatus as defined in claim 1, wherein:

said cutter head axis and said pivot axis intersect one another.

4. The clamping apparatus as defined in claim 1, further including:

means for mounting the clamping apparatus at the grinding machine so as to be displaceable at all sides in a given plane.

5. The clamping apparatus as defined in claim 1, wherein:

said means for rotatably and pivotably mounting said cutter head about said cutter head axis and about said pivot axis comprises a rotatable element;

a pivotal element cooperating with said rotatable element;

a cutter head support for receiving the cutter head;

said pivotal element being pivotable upon said rotatable element about said pivot axis; and said cutter head support being rotatably mounted about the cutter head axis upon the pivotal element.

6. The clamping apparatus as defined in claim 5, wherein:

said clamping apparatus having an axis of rotation; and a lifting table at which there is mounted the rotatable element for rotation about said axis of rotation.

7. The clamping apparatus as defined in claim 6, further including:

hydrostatic bearing means arranged between said pivotal element and said rotatable element and between said rotatable element and said lifting table.

8. The clamping apparatus as defined in claim 5, further including:

adjustment means arranged between said cutter head support and said pivotal element and serving for adjustment of the cutter head and the cutter head support for grinding the same surface of a further cutter blade of a similar type of cutter blades.

9. The clamping apparatus as defined in claim 8, wherein:

said adjustment means comprises: an exchangeable indexing disk secured to the cutter head support;

adjustment dog means;

an adjustment ring for securing the adjustment dog means at the pivotal element;

cylinder means having a piston means displaceably arranged therein;

said piston means having an adjustable stroke;

said cylinder means being fixedly connected with said pivotal element; and said piston means being detachably connected with said cutter head support.

10. The clamping apparatus as defined in claim 9, wherein:

said indexing disk contains a number of recesses corresponding to the number of types of cutter blades of the cutter head and with which there positively engage the adjustment dog means.

11. The clamping apparatus as defined in claim 9, wherein:

said adjustment ring together with said adjustment dog means is rotatably arranged for rotational movement about the cutter head axis.

12. The clamping apparatus as defined in claim 6, further including:

fluid operated-cylinder means for movably supporting said lifting table for movement in a direction perpendicular to said fluid operated-cylinder means; and said fluid operated-cylinder means being arranged in a plane which is essentially parallel to said lifting table.

* * * * *